United States Patent [19]

Rickert et al.

[11] 4,309,920

[45] Jan. 12, 1982

[54] COMMUTATOR BRUSH TOOL

[76] Inventors: Leonard R. Rickert, 1075 Bristol Rd., Warminster, Pa. 18974; Russell L. Rickert, 925 Maple Ave., Ardsley, Pa. 19038

[21] Appl. No.: 119,907

[22] Filed: Feb. 8, 1980

[51] Int. Cl.[3] ..... B25B 27/00

[52] U.S. Cl. ..... 81/3 R

[58] Field of Search ..... 29/225, 228, 243.5, 29/244, 267, 278; 81/3 R

[56] References Cited

U.S. PATENT DOCUMENTS

| | | | |
|---|---|---|---|
| 1,641,994 | 9/1927 | Schesvold et al. | 29/278 X |
| 2,742,803 | 4/1956 | Simpkin | 81/3 R |
| 2,789,287 | 4/1957 | Lambert | 81/3 R X |
| 2,850,315 | 9/1958 | Archer | 81/3 R X |
| 4,083,101 | 4/1978 | Coller | 29/278 X |

FOREIGN PATENT DOCUMENTS

| | | | |
|---|---|---|---|
| 21288 | 7/1929 | Australia | 81/3 R |

*Primary Examiner*—James G. Smith

*Attorney, Agent, or Firm*—John J. Simkanich

[57] ABSTRACT

A tool for facilitating the replacement of brushes, typically, carbon, brass or bronze, in a dynamoelectric machine comprises an elongated channel shaped portion including a generally flat bottom wall and a pair of parallel side walls forming the channel configuration. One end of the channel portion is integrally formed with a gripping portion and at the other end, the side walls are relieved. In use, the relieved end of the channel portion is inserted between the brush and the coil spring biasing it inwardly and the tool is fulcrumed to move the spring out of engagement with the brush.

4 Claims, 3 Drawing Figures

COMMUTATOR BRUSH TOOL

Dynamoelectric machines include brushes, typically carbon, brass or bronze, that cooperate with a commutator in a manner well known in the art. During maintenance procedures, it is common to either remove or replace the brushes and such is time consuming and difficult because of the arrangement supporting the brushes in the machine. For example, automobile starter motors, particularly those used in Ford Motor Company automobiles, include a generally cylindrical housing in which the brushes and commutator are located adjacent one end of the cylindrical wall. The brushes are confined in box-like structures providing a socket, open at the top and bottom, which are circumferentially spaced about the commutator. A coil spring is associated with each brush and is arranged with a free end bearing on an end surface thereof to bias the brush radially inwardly into operative relationship with the commutator. When removing the brush, the end of the coil spring must be retracted and held in an out of the way position while the brush is withdrawn from its socket. The spring must be retained in this position when the brush is reinstalled or when a new brush is inserted. After insertion the end of the spring is released so that it again bears on the brush.

Access to the brushes is provided by a series of circumferentially spaced openings formed in the cylindrical wall adjacent the brushes and commutator. The access and working space is so limited that the manual manipulations described above are extremely difficult to perform. Thus, the replacement of brushes is a time-consuming operation.

Accordingly, it is an object of this invention to provide a tool for facilitating the removal and/or replacement of brushes in dynamoelectric machines.

It is another object of this invention to provide a relatively simple and inexpensive tool that is easy to use and that permits the easy retraction of a spring from engagement with a carbon brush.

These and other objects of this invention are accomplished by providing a tool having an elongated channel shaped portion including a generally flat bottom wall and a pair of parallel side walls extending from the bottom wall to form the channel configuration. Integrally formed at one end of the elongated channel portion is an enlarged gripping portion. Adjacent the other end of the channel portion, the side walls are relieved so that they extend upwardly at an acute angle to the bottom wall.

In use, the tool is inserted between the free end of the coil spring and the brush with the end of the spring seated on the bottom wall and being confined thereto by the side walls. The tool is then fulcrumed about a conveniently located machine portion, for example, the edge of the access opening in the housing, to retract the spring radially outwardly from engagement with the brush. When the tool has been fulcrumed a sufficient distance to clear the upper edge of the socket holding the brush, the tool can be slid inwardly so that the outer surface of the bottom wall engages the outer portion of the upper edge of the socket whereupon the tool can be fulcrumed about that edge to a position where neither the tool nor the spring interferes with the upward motion of the brush as it is removed from its socket. Now the old brush can be removed, the new brush inserted and the tool removed so that the spring bears on the top of the new brush.

For a better understanding of the invention, reference is made to the following description of a preferred embodiment, taken in conjunction with the figures of the accompanying drawing, in which.

Figure 1:
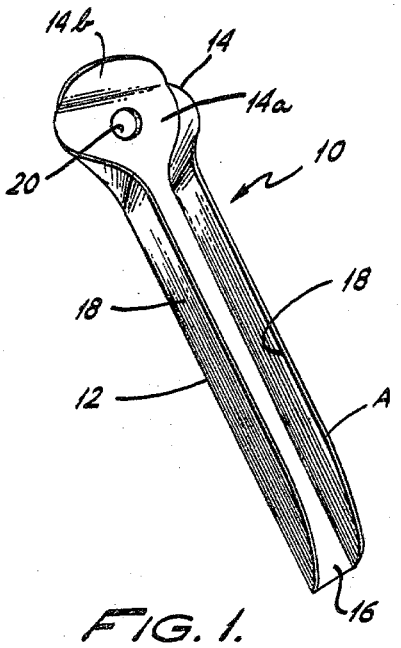
FIG. 1 is a perspective view of a tool in accordance with this invention.

Referring first to FIG. 1 of the drawing, a tool 10 in accordance with this invention is illustrated. The tool 10 is an unitary piece made from a relatively rigid material, for example, certain heavy gauge metal. It includes an elongated generally channel shaped portion 12 and an integrally formed gripping portion 14.

The elongated portion 12 includes a bottom wall 16 and a pair of integrally formed side walls 18, 18 extending generally parallel to each other, in the same direction, to form the channel like configuration. At the ends distant from the gripping portion 14, the side walls 18, 18 are relieved, that is, extend upwardly at an acute angle from the bottom wall 16 to their full height at a point intermediate their ends. In the preferred embodiment of the invention disclosed herein, the relieved portion is provided by having the upper or free edges of the side walls 18, 18 radiused from their free end to their full height at a point A located intermediate the axial ends of the bottom wall 16. Point A can be located proximate the axial midpoint of the bottom wall 16. Rather than being radiused, the upper edges of walls 18, 18 can taper along a straight line.

The gripping portion 14 includes a flat surface portion **14*a*, conveniently formed as an extension of the bottom wall 16 so that it extends axially beyond the side walls 18, 18 a sufficient distance to accommodate a human thumb. This flat surface portion 14*a* is not bounded by the side wall 18, 18 and extends laterally beyond these walls. Thus, a thumb can fit on the flat portion 14*a* in a direction transverse to the axis of the elongated portion 12 so that the tool can be gripped between the thumb and forefinger of one hand. At the end of the flat portion 14*a* there is formed an upstanding wall 14*b* functioning as a thumb rest and which can also be gripped between a thumb and a forefinger. The wall 14*b* forms an obtuse angle with the flat surface portion 14*a*. If desired a hole 20 can be formed in the flat portion 14*a* so that the tool 10** can be hung on a nail or hook member when it is not in use.

Figure 2:
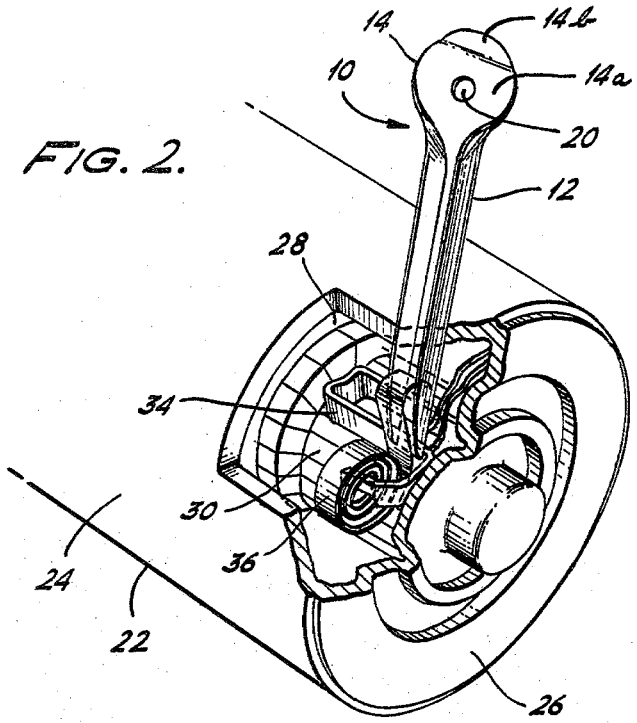
FIG. 2 is a perspective view of a dynamoelectric machine with portions thereof broken away to illustrate the use of the tool.

To facilitate an understanding of how the tool is used, certain basic portions of a dynamoelectric machine with which the tool is usable will first be explained. In FIG. 2, there is illustrated an automobile starter motor 22 of the type used in Ford Motor Company automobiles. The starter motor 22 includes a housing having a generally cylindrical side wall 24 and a pair of circular end walls, one of which is shown at 26. Adjacent end wall 26, the cylindrical wall 24 is formed with a series of circumferentially spaced apart access openings 28. Radially inwardly of each of the openings 28 is located a commutator 30 of conventional design and located about the periphery of the commutator are a plurality of conventional brushes 32 that cooperate with the commutator in the usual way. The brushes 32 may be made of carbon, bronze, brass or any similarly suitable material and are retained in position by sockets 34 each in the form of an open box-like structure. That is, each socket 34 is formed by two pair of parallel walls defining, in plain view, a rectangle and the top and bottom portions are open so that a brush 32 may fit through the top of the socket and also the bottom thereof to engage the commutator 30. Biasing the brushes 32 into operative relationship with the commutator 30 are coil springs 36 arranged such that their free ends bear on the radially outermost or top surface of the brushes 32.

When a brush 32 is to be removed it should be understood that the free end of the coil spring 36 must be moved out of engagement with the brush a distance sufficient to allow outward movement of the brush out of its socket. While replacing the brush or inserting a new one into the socket, the spring 36 must be retained in that position so as not to interfere with the inward movement of the brush into the socket.

Figure 3:
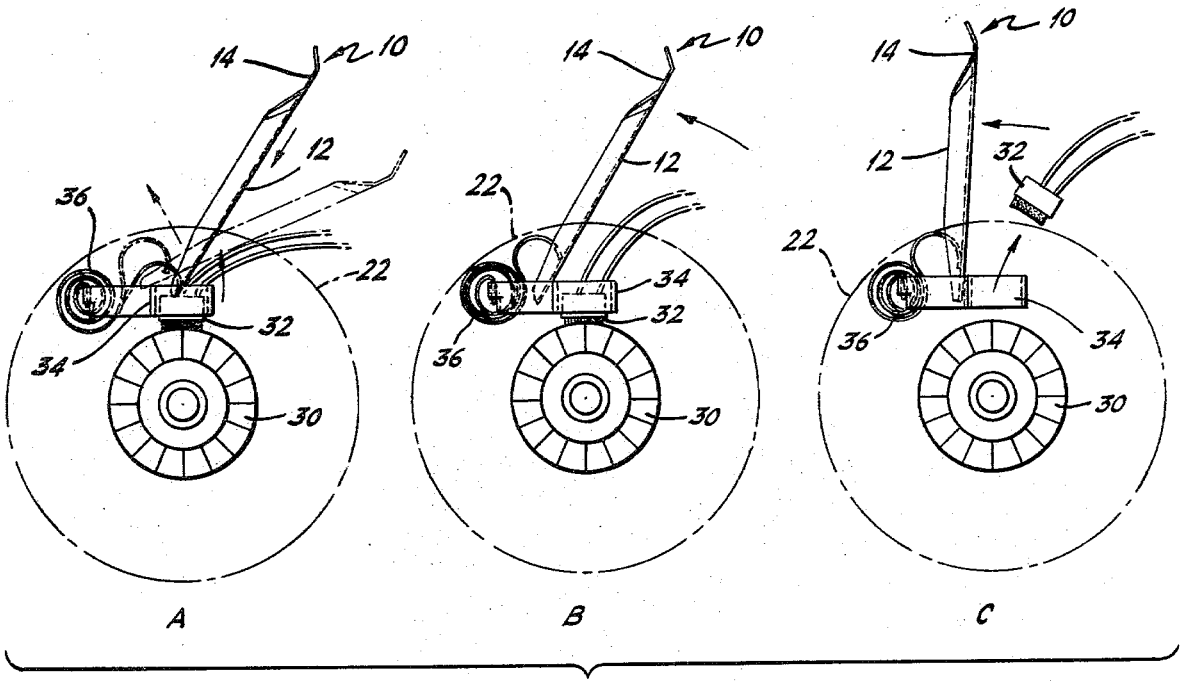
FIGS. 3A through 3C is a schematic illustration illustrating the various manipulative steps in using the tool.

The tool 10 can be manipulated by one hand and is inserted through the access opening 28 adjacent the brush 32 to be removed. The free relieved end of the channel portion 12 is inserted between the bearing end of the spring 36 and the radially outermost surface of the brush 34 such that the free end of the spring is seated on the inside of bottom wall 16 and is confined between side walls 18, 18 to minimize lateral movement. The outside surface of bottom wall 16 bears on the edge of the access opening 28 during this manipulation. The tool 10, being grasped between a thumb and forefinger at the gripping portion 14, is fulcrumed against the edge of the access opening 28 in a clockwise direction as illustrated in FIG. 3A. Inasmuch as the side walls 18, 18 are relieved, they do not interfere with the pivoting motion. When the free end of the spring 36 is located above the top outer surface of the socket 34, the tool 10 is slid inwardly to a position where the outer surface of the bottom wall 16 seats on the outside of the top edge of the socket 34 as also shown in FIG. 3A. The tool 10 is now fulcrumed in a counterclockwise direction as shown in FIG. 3B about the top edge of the socket 34 until the tool 10 is in flat bearing engagement with the outer surface of the socket 32 as clearly shown in FIG. 3C. In this position, both the spring 36 and the tool 10 are located so as not to interfere with movement of the brush 32 into and out of the socket 34.

The lead wires attached to the brush 32 can now be grasped in the mechanic's other hand and pulled outwardly to remove the brush out of the socket 34. During this procedure the mechanic's one hand is used to retain the tool 10 and spring 36 in the position illustrated in FIG. 3C. When it is desired to replace the brush back into the socket or to place a new brush therein, this brush is inserted into the socket 34 and, thereafter, the tool 10 is rotated in the clockwise direction from the position illustration in FIG. 3C and then slid outwardly through the access opening 28 allowing the bearing end of the spring 36 to engage the radially outermost surface of the brush.

While in the foregoing there has been described a preferred embodiment of the invention it should be obvious to those skilled in the art that further changes and modifications can be made without departing from the true spirit and scope of the invention as recited in the appended claims.

I claim:

1. A tool comprising an elongated C-shaped channel portion including a flat bottom wall and a pair of parallel side walls extending perpendicularly upwardly therefrom, and a gripping portion formed at one end of said C-shaped channel portion, this gripping portion being a flat gripping surface formed by a flat extension of said flat bottom wall and a lateral projection of said side walls, said parallel side walls being relieved at said other end of the said C-shaped channel portion, wherein said flat gripping surface also includes an upstanding wall extending from the end thereof.

2. A tool in accordance with claim 1 wherein said side walls are relieved forming at said other end of said tool an acute angle with said bottom wall.

3. A tool in accordance with claim 1 wherein said side walls are relieved at said other end of said tool forming a radius at said bottom wall.

4. A tool in accordance with claim 1 wherein said upstanding wall forms an obtuse angle in said gripping surface.

* * * * *